US006702454B2

(12) United States Patent
Grajetzky et al.

(10) Patent No.: US 6,702,454 B2
(45) Date of Patent: Mar. 9, 2004

(54) RECESSED LUMINAIRE HAVING A HOLDER RING FOR ADDITIONAL COMPONENTS

(75) Inventors: Hans-Joachim Grajetzky, Lemgo (DE); Heike Schmidtpott, Bad Sulzuflen (DE)

(73) Assignee: Zumtobel Staff GmbH & Co. KG, Lemgo (DE)

( * ) Notice: Subject to any disclaimer, the term of this patent is extended or adjusted under 35 U.S.C. 154(b) by 0 days.

(21) Appl. No.: 10/244,470

(22) Filed: Sep. 17, 2002

(65) Prior Publication Data

US 2003/0063470 A1 Apr. 3, 2003

Related U.S. Application Data

(63) Continuation of application No. PCT/EP01/01903, filed on Feb. 20, 2001.

(30) Foreign Application Priority Data

Mar. 17, 2000 (DE) ..... 100 13 087

(51) Int. Cl.[7] ..... F21S 8/02

(52) U.S. Cl. ..... 362/365; 362/347; 362/433

(58) Field of Search ..... 362/347, 365, 362/433, 364, 366, 148, 150, 147

(56) References Cited

U.S. PATENT DOCUMENTS

| | | | | |
|---|---|---|---|---|
| 3,130,949 A | * | 4/1964 | Erhardt et al. | 362/365 |
| 5,758,958 A | | 6/1998 | Chen | 362/307 |
| 5,931,567 A | | 8/1999 | Salzmann et al. | 362/304 |
| 6,155,693 A | | 12/2000 | Spiegel et al. | 362/147 |

FOREIGN PATENT DOCUMENTS

| | | | |
|---|---|---|---|
| DE | 9112496.4 U1 | | 12/1991 |
| DE | 9200978.6 U1 | | 3/1992 |
| DE | 4344431 A1 | | 6/1995 |
| DE | 29806065 U1 | | 6/1998 |
| DE | 29915780 U1 | | 12/1999 |
| DE | 100 13 086 | * | 9/2001 |
| WO | WO 01/69128 | * | 9/2001 |

* cited by examiner

*Primary Examiner*—Alan Cariaso
*Assistant Examiner*—Bao Truong

(57) ABSTRACT

A recessed luminaire (1), has a dome-shaped reflector (6), a light source (8) arranged therein, a mounting ring (9) which engages around the reflector (6) near to its edge. A holder ring (41) for additional components, such as a glass plate or the like, to be attached to the mounting ring (9), is also provided, the holder ring (41) having connection means for fastening it on the mounting ring (9). At least two plug-in elements (45) having plug-in pins (46*a*) and radially developing plug-in recesses (46*a*) are provided on the mounting ring (9), for plugging-in of the plug-in pins (46*b*).

13 Claims, 3 Drawing Sheets

RECESSED LUMINAIRE HAVING A HOLDER RING FOR ADDITIONAL COMPONENTS

CROSS REFERENCE TO RELATED APPLICATIONS

This is a Continuation of International Application PCT/EP01/01903 filed Feb. 20, 2001 which in turn claims priority of German application DE 100 13 087.9, filed Mar. 17, 2000, the priorities of which are hereby claimed, said International Application having been published in German, but not in English, as WO 01/69129 A1 on Sep. 20, 2001.

BACKGROUND OF THE INVENTION

1. Field of the Invention

The invention relates to a recessed luminaire and more particularly, the invention concerns novel means to improve the use of such luminiare.

2. Description of the Related Art

A recessed luminaire of this kind is described in DE 43 44 431 A1. This known recessed luminaire has a base frame, consisting of a mounting ring, which in axial cross-section is formed in an angled manner having a coaxial tube support and a flange part projecting outwardly therefrom, there extending from the edge of the tube support away from the emission direction, in an arc-shape, to a common ridge zone, three struts to which the reflector is releasably attached.

For the selective mounting of a holder ring for additional components there are provided on the side of the mounting ring away from the light source connection means in the form of a connection ring for the holder ring. The connection ring has on its side towards the mounting ring axially projecting snap hooks which are latched behind associated latch edges on the inner side of the tube support, whereby the snap hooks are located in an intermediate space between the tube support and the side wall of the reflector. The ring body of the connection ring has a U-shaped cross-sectional form. In the hollow space of the connection ring formed by means of the U-shape there are pivotally arranged, distributed around the circumference, three tensioning levers, in the region of axial cut-outs, with which holder arms arranged on the axes of the tensioning levers are radially pivotably mounted. With the holder arms, the holder ring can be mounted on the side of the connection ring which is away from the mounting ring. The holder ring serves for the holding of additional components, such as a glass plate or the like which is located before the emission opening of the luminaire.

This known recessed luminaire has several disadvantages. On the one hand, the connection ring and the holder ring increase the axial dimension of the recessed luminaire in the region arranged in front of the mounting ring. This is unavoidable due to the presence of the connection ring, which has a considerable axial dimension, in order to be able to receive the tensioning levers. On the other hand, the known configuration is disadvantageous because the connection ring is clearly visible for the observer, as a result of which the structure not only appears to be large, but also its appearance is adversely affected. A further disadvantage consists in that the known configuration is of complex configuration and production, not only with regard to the arrangement and mounting of the tensioning levers. Furthermore, the mounting or de-mounting is complex, whereby it is to be taken into account that the tensioning levers are not easy to access.

SUMMARY OF THE INVENTION

An object of the present invention is to so configure a recessed luminaire of the kind indicated in the introduction that a simple and axially small construction can be obtained.

According to the invention, there is provided a novel recessed luminarie which comprises a dome-shaped reflector having a light source, a mounting ring which engages around the reflector near its edge, a holder ring attached to the mounting ring, and connection means for fastening the holder ring to the mounting ring. The connection means includes at least two separate plug-in elements having radially inwardly directed plug-in pins and radially developing plug-in recesses on the mounting ring into which the plug-in elements can be plugged in with their plug-in pins in a direction radially inwardly from outside.

With the configuration in accordance with the invention, the connection means between the mounting ring and the holder ring are formed by means of at least two plug-in elements having plug-in pins and radially developing plug-in recesses on the mounting ring for plugging in of the plug-in pins. Due to the radial direction of the connection means there can be realized a structure which is thin in the axial direction, which is advantageous and desired in order to avoid a large visible projection of the recessed luminaire from the installation wall. A radial plug-in movement, in particular a radially inwardly directed plug-in movement, is unproblematic since at least two plug-in elements are present which can be mounted independently of one another and can for example be formed as segments. A further advantage of the configuration in accordance with the invention consists in that the plug-in elements in accordance with the invention can be simply formed, so that the recessed luminaire can also be produced economically. For connection of the plug-in elements with the holder ring there can be employed mutually corresponding known connection means.

It is advantageous to form the connection means between the plug-in elements and the holder ring by means of so-called bayonet connections, whereby two or more, for example three, bayonet connection means may be provided arranged distributed on the circumference. Such a configuration is advantageous both for reasons of handling upon closing and opening of the connection and also for design technical reasons. It is further advantageous to form the holder ring as a sleeve-shaped component, which in the mounted disposition covers over both the plug-in elements and also a flange part of the mounting frame and, if applicable, also an edge flange of the reflector. Thereby it is to be taken into account that in the mounted condition there can remain between the holder ring and the installation wall a gap, as a so-called shadow edge, which does not adversely influence the appearance of the recessed luminaire.

Further features are described and claimed herein which likewise contribute to improving the construction in terms of design technical considerations and also handling, and to ensure a simple and economic production.

BRIEF DESCRIPTION OF THE DRAWINGS

Below, the invention and further advantages which can be achieved thereby will be explained in more detail with reference to advantageous configuration and simplify drawings.

DETAILED DESCRIPTION OF THE PREFERRED EMBODIMENT

Figure 1:
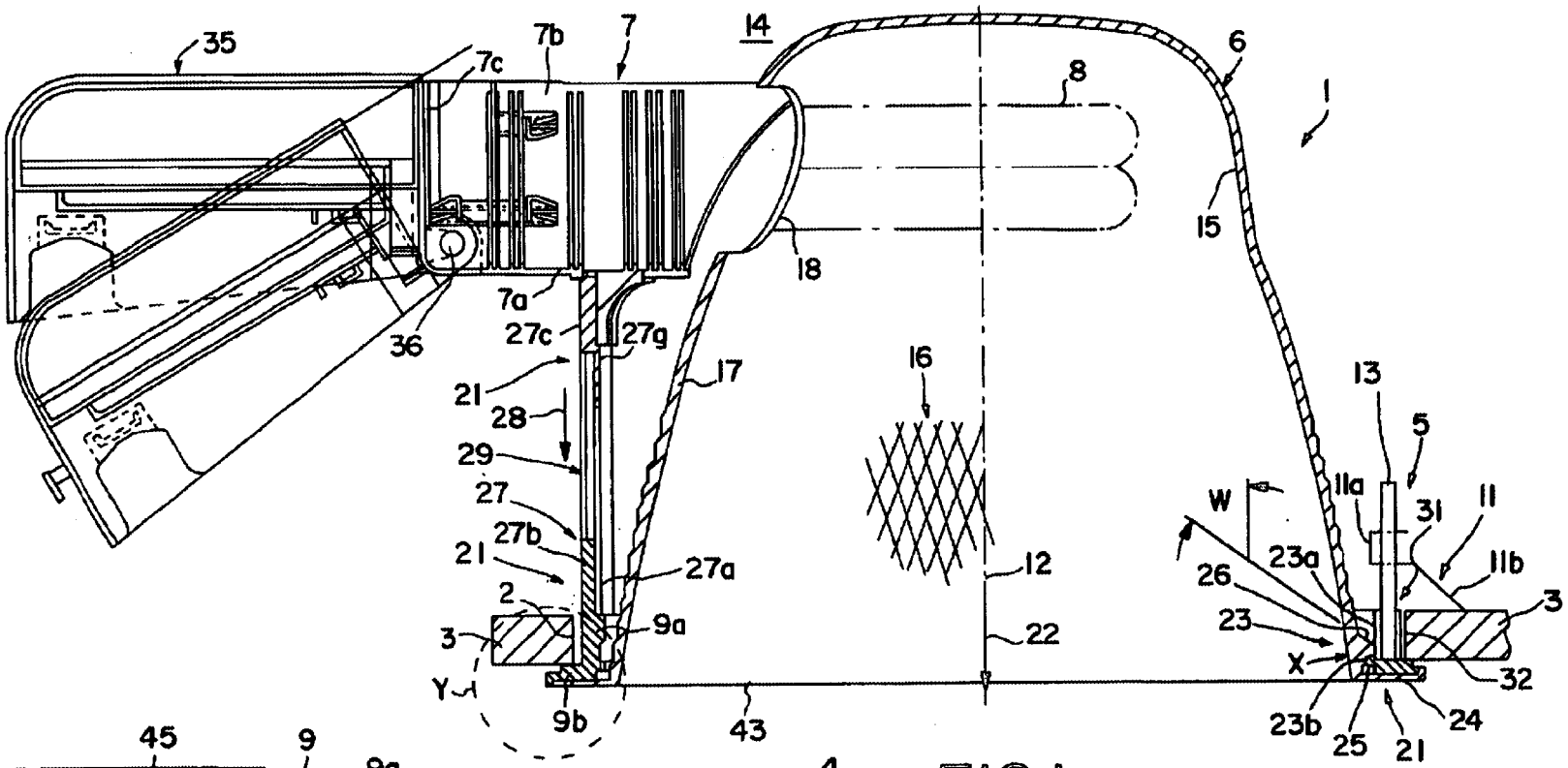
FIG. 1 is a partial section view, taken in elevation, of a recessed luminaire in accordance with the invention.

As shown in FIG. 1, the recessed luminaire, designated in its entirety by 1, can be installed in an installation opening 2 of an installation wall 3 which may be a ceiling or a wall of a room 4 to be illuminated with the recessed luminaire 1. For fastening the recessed luminaire 1 to the installation wall 3 there are provided first holder means 5 which will be described further below.

The main parts of the recessed luminaire 1 are a dome-shaped reflector 6, a light source carrier 7 for receiving at least one light source 8 and a mounting ring 9, which with a tube support 9*a* and a flange part 9*b* outwardly projecting from this tube support, is formed with an angle shape and with the aid of the first holder means 5 can be fixed in the installation opening, for example on the installation opening edge. For this purpose there may serve a plurality of holder arms 11 arranged distributed around the circumference and formed for example by means of leaf springs, of which only one is schematically illustrated in FIG. 1. The holder arms 11 are, with a base section 11*a,* each displaceably mounted on a carrier bar 13 extending approximately parallel to the middle axis 12 of the recessed luminaire 1, whereby in each case the base section 11*a* is self-actingly arrested on the carrier bar 13, in particular by means of a clamping effect, when a holder finger 11*b,* outwardly projecting and engaging below the installation opening edge, bears with a pressure force on the side of the installation wall 3 away from the room 4. By these means, the mounting ring 9 is fixed in the installation opening 2, whereby its tube support 9*a* projects into the installation opening 2 and its flange part 9*b* bears on the installation wall 3. Axially, the tube section 9*a* is relatively short. It does not need to project far into the free space 14 behind the installation wall 3. It is sufficient when the axial length of the tube support 9*a* corresponds approximately to the thickness of the installation wall 3, whereby the axial length may be dimensioned to be somewhat greater or also somewhat smaller. The width of the flange part 9*b* is so dimensioned that the flange part 9*b* engages below the installation opening edge and therewith covers over the installation gap between the tube support 9*a* and the installation opening edge.

Figure 3:
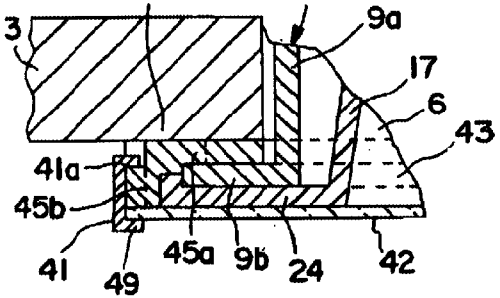
FIG. 3 is a fragmentary view showing on an enlarged scale a portion designated by Y in FIG. 1, with additionally mounted accessory parts.

Preferably, the reflector 6 has the form of a dome closed in the ridge region, the inner surface 15 of which is constituted as a reflection surface and which may be formed for example at least in the free edge region with facet surfaces 16, of which a part region is illustrated by hatching by way of example in lozenge-like shape. In the upper region of its side wall 17, the reflector 6 has a lead-through hole 18 in the region of which the light source carrier 7 is held, for example in a position outwardly opposite the lead-through hole 18, as FIG. 1 shows. With the present exemplary embodiment, the light source carrier 7 is a fitting carrier having one or more non-illustrated fittings which, with one or more lamps, are accessible from the inner space 19 of the reflector 6, so that at least one lamp is mountable from the inside onto the fitting carrier in a position in which its light source 8 is located in the inner space 19. The reflector 6 is releaseably connected or connectable with the mounting ring 9 by means of a plug-in fitting designated in its entirety by 21. The plug-in fitting 21 makes it possible to insert the reflector into the mounting ring 9 in the direction opposite to the light emission direction 22, and thereby to connect it with the mounting ring 9. There may be provided a plurality, for example three, latching devices 23 distributed around the circumference for the releaseable latching of the reflector 6 with the mounting ring 9. The latching devices 23 have in each case a latch nose 23*a* which in the latched position engages behind a latch edge 23*b*. This engagement behind is, due to the elasticity present of at least one of the parts standing in latching engagement, releaseable in that the latching can be overcome manually or by means of a tool, here by means of a movement of the reflector 6 in the light emission direction 22. With the present configuration, the latch nose 23*a* is arranged on the outer side of the side wall 17, preferably being formed thereon in one piece. The axial spacing of the latching elements from the free edge of the reflector 6 or of the mounting ring 9 is selected to be of such a size that in the latching position an edge flange 24 projecting outwardly from the side wall 17 bears on the flange part 9*b* and preferably covers this over or projects over this, whereby it may also engage behind the flange part 9*b* in an angled manner, as FIGS. 1 and 3 show.

The latching edge 23*b* may be formed by means of an inner web 25 on the inner surface of the mounting ring 9.

Figure 2:
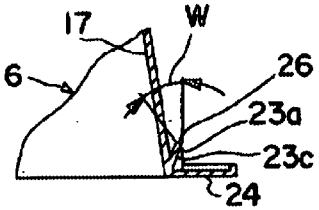
FIG. 2 is a fragmentary view showing an enlarged alternative configuration of the portion designated as X in FIG. 1.

FIG. 2 shows the latching nose 23*a* in a modified configuration. Here, the latching nose 23*a* is yieldingly mounted, so that it can spring in against an elastic return force. Here, the latching nose 23*a* may be arranged on a spring arm 23*c*, which may extend along or obliquely of the middle axis 12 and which may preferably be formed in one piece on the mounting ring 9 or on its side wall 17. With the present exemplary embodiment the spring arm 23*c* is formed on in the corner region of the mounting ring 9 whereby it extends, if applicable obliquely, in the direction opposite to light emission direction 22. The spring arm 23*c* can, due to its material elasticity, be transversely elastically bent in. In order to simplify or make possible the latching, with the present exemplary embodiments, the latching nose 23*a* and/or the latching edge 23*b* or the inner web 25, has associated therewith an oblique or rounded lead-in surface 26, which manifests an acute angle W with reference to the middle axis 12, which angle is open in the direction opposite to the emission direction 22.

The light source carrier 7 is connected exclusively with the mounting ring 9, by means of a special connection means, here connected exclusively with the tube support 9*a* of the mounting ring. The connection means are formed by means of a plug-in connection having a plug-in fitting 27*a* on the one plug-in connection part and a plug-in pin 27*b*, which can be inserted in the plug-in fitting 27*a*, on the other connection part. The plug-in direction 28 of the plug-in connection 27 extends approximately parallel to the middle axis 12 and in the emission direction 22. The cross-sectional form of the plug-in fitting 27*a* and of the plug-in pin 27*b* is preferably non-round. By these means there is formed a rotation lock which positions the light source carrier 7 in its transverse disposition. The plug-in connection 27 distinguishes itself through a great stability, with simple and small construction, whereby it can in particular be constituted to be relatively thin, and thus mounted on the tube support 9*a*, in particular formed in one piece thereon, which should be formed as thin as possible in order to have a greater cross-sectional surface available for the reflector. This can be realized in that the plug-in pin has the cross-sectional form of a broad and relatively thin web. This applies also for the attachment of the carrier bars 13 which preferably are likewise connected with the tube support 9*a* by means of plug-in fittings 31. Preferably there are provided, prefabricated, in the tube support 9*a* in each case an undercut groove or plug-in recesses 32 forming a plug-in fitting 31 into which the carrier bars 13 are placed and attached, for example by means of gluing or press fitting. There can be seen from FIG. 4 the elongate, in the circumferential direction, cross-sectional form of the for example three plug-in recesses 32 for the carrier bars 13. The plug-in recesses 32 may, for the purpose of material savings and small width, be undercut on one side and thus open to the side; here they are inwardly open.

Figure 5:
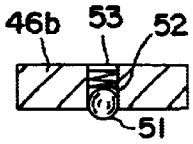
FIG. 5 is a partial view taken along line section V—V of FIG. 4.
Figure 6:
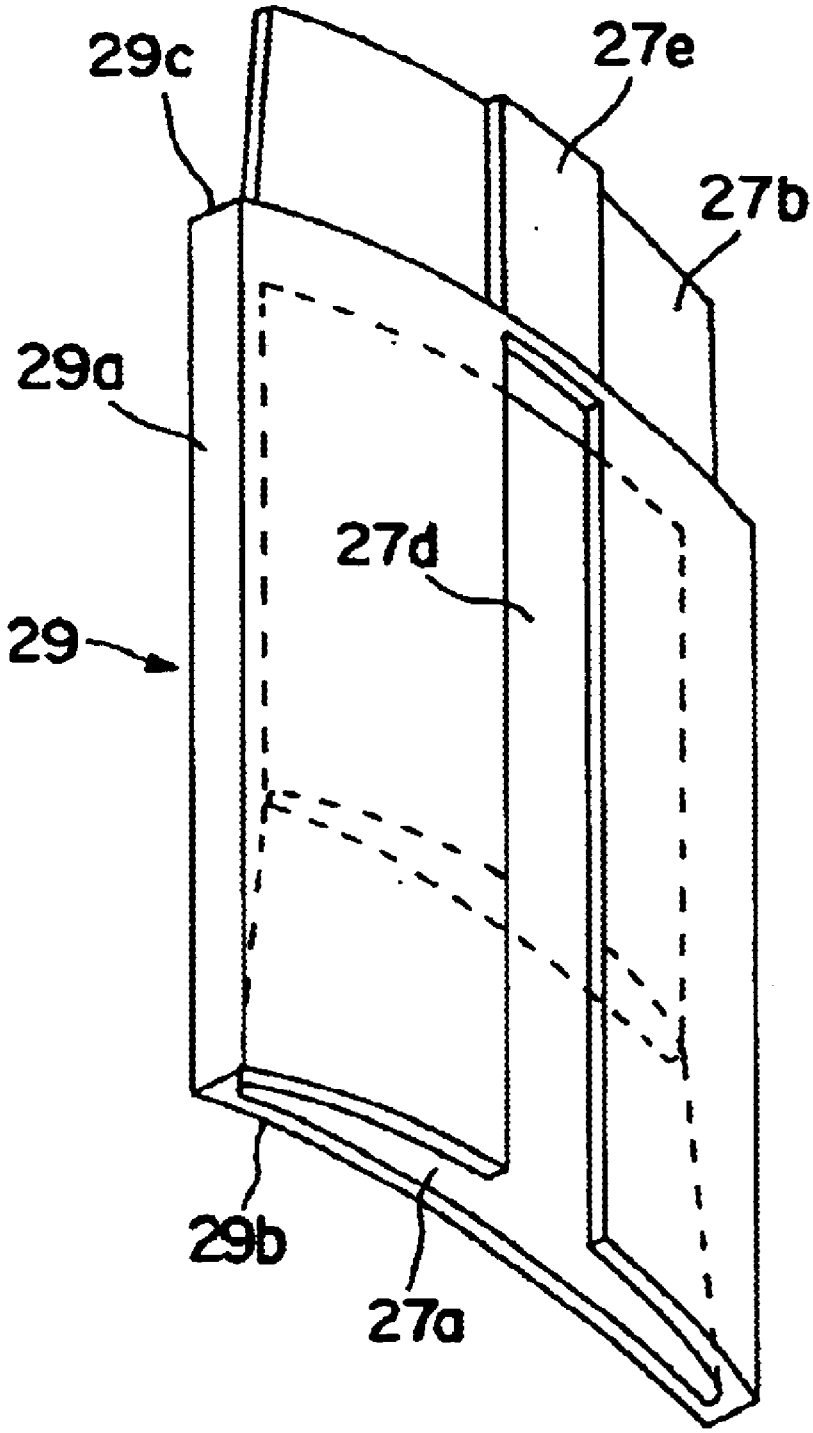
FIG. 6 is a perspective view of an adaptor formed as an extension piece, for use in the luminaire of FIG. 1.

With the present exemplary embodiment according to FIGS. 1 and 5, the plug-in connection has, between two matching plug-in connection parts, a plug-in adaptor 29 which on its one end has a plug-in recess or plug-in fitting 27*a* matching the plug-in connection 27 present, and at its other end has a matching plug-in pin 27*b*, and which forms an extension piece. Through this it is possible to realize the plug-in connection 27 selectively with or without a plug-in adapter 29. Without plug-in adaptor 29, the plug-in connection 27 is suitable for a reflector 6 of lesser structural height, which otherwise is formed in the region of its free edge as described above. Through this it is possible to combine one and the same mounting ring with reflectors 6 of differently sized structural height and thus to adapt the luminaire to different illumination requirements. In the configuration according to FIG. 1 there are thus present in fact two plug-in connections 21 in coaxial arrangement. It is advantageous to associate with the plug-in connection or connections 21 in each case a positioning device 33 which is effective in the plugged together position, which brings about a fixing of the plug-in connection parts in the plugged together condition. This is advantageous for providing the plug-in connection 27 with a certain stability in the plugged together condition. Further, by means of a such a positioning device 33 it is prevented that the plug-in connection parts can be released from one another unintentionally, for example upon the mounting of a lamp. The positioning device 33 can be formed for example by means of a latching device or a clamping device. The positioning device 33 is preferably releaseable by being overcome manually with a certain application of force. A clamping device can for example be realized in that the plug-in pin 27*b* is formed to be conically convergent towards its free end and the plug-in fitting 27*a* has a matching and corresponding form. Such a conical configuration also facilitates the plugging together, because in the entry region of the plug-in fitting a considerable play for movement is available. Further, the conical form can provide the positioning device 33 in that in the inserted condition the cone connection jams. The plug-in recess 27*a* can be slotted on a broad side by means of a longitudinal slot 27*d* in which a web 27*e* on the plug-in pin 27*b* can engage. The plug-in adaptor 29 may have a thickened shaft 29 through which there are provided on its plug-in recess 27*a* and its plug-in pin 27*b* end or step surfaces 29*b*, 29*c* which, with corresponding step surfaces 27*f*, 27*g* at the foot of the corresponding plug-in pin 27*b* and on the edge of the corresponding plug-in recess 27*a*, form stops.

Within the scope of the present invention both plug-in connection parts of the plug-in connection 27 may each project, from the parts carrying them, towards one another with a rod-like base section 27*c*. The plug-in connection parts standing up from the light source carrier 7 may be formed on, preferably in one piece, a floor wall 7*a* of a housing forming the light source carrier 7, which furthermore may have side walls 7*b* lying opposite to one another and at its side away from the reflector 6 an end wall 7*c* which if appropriate may be formed with cable lead-through holes.

The light source carrier 7 may, on its end side away from the reflector 6, be connected with a cable connector housing 35. With the present configuration, the connector housing 35 is a separate component which is pivotable between a transversely upstanding position, referred to the middle axis 12, into a position displaced towards the mounting ring 9. For fixing the connector housing 35 in the first-mentioned position there may be provided a positioning device, for example in the form of a latching device or a clamping device. With the present exemplary embodiment a joint 36, making the pivoting possible, is arranged in the edge region between the floor wall and the end wall.

The mounting ring 9 is suitable as a carrier for a holder ring 41 for holding at least one additional component 42 or accessory part, which may be for example a light permeable plate, which is releasably held by the holder ring 41 in a position covering the emission opening 43 of the reflector 6. For releaseable connection directly or indirectly with the flange part 9*b* there is provided a so-called bayonet connection 44 having bayonet connection parts which correspond to one another.

With the present configuration there serve for the releaseable attachment of the holder ring 41 at least two, for example three, plug-in elements 45 arranged distributed on the circumference, here for example in the form of ring segments which on the one hand, in each case by means of a plug-in connection 46 having a plug-in recess 46*a* on the one connection part and a plug-in pin 46*b* insertable therein on the other connection part, are connectable with the flange part 9*b* of the mounting frame 9. For connecting the plug-in elements 45 with the holder ring 41 there serve connection parts corresponding to one another, which are preferably formed by means of the bayonet connection 44.

Figure 4:
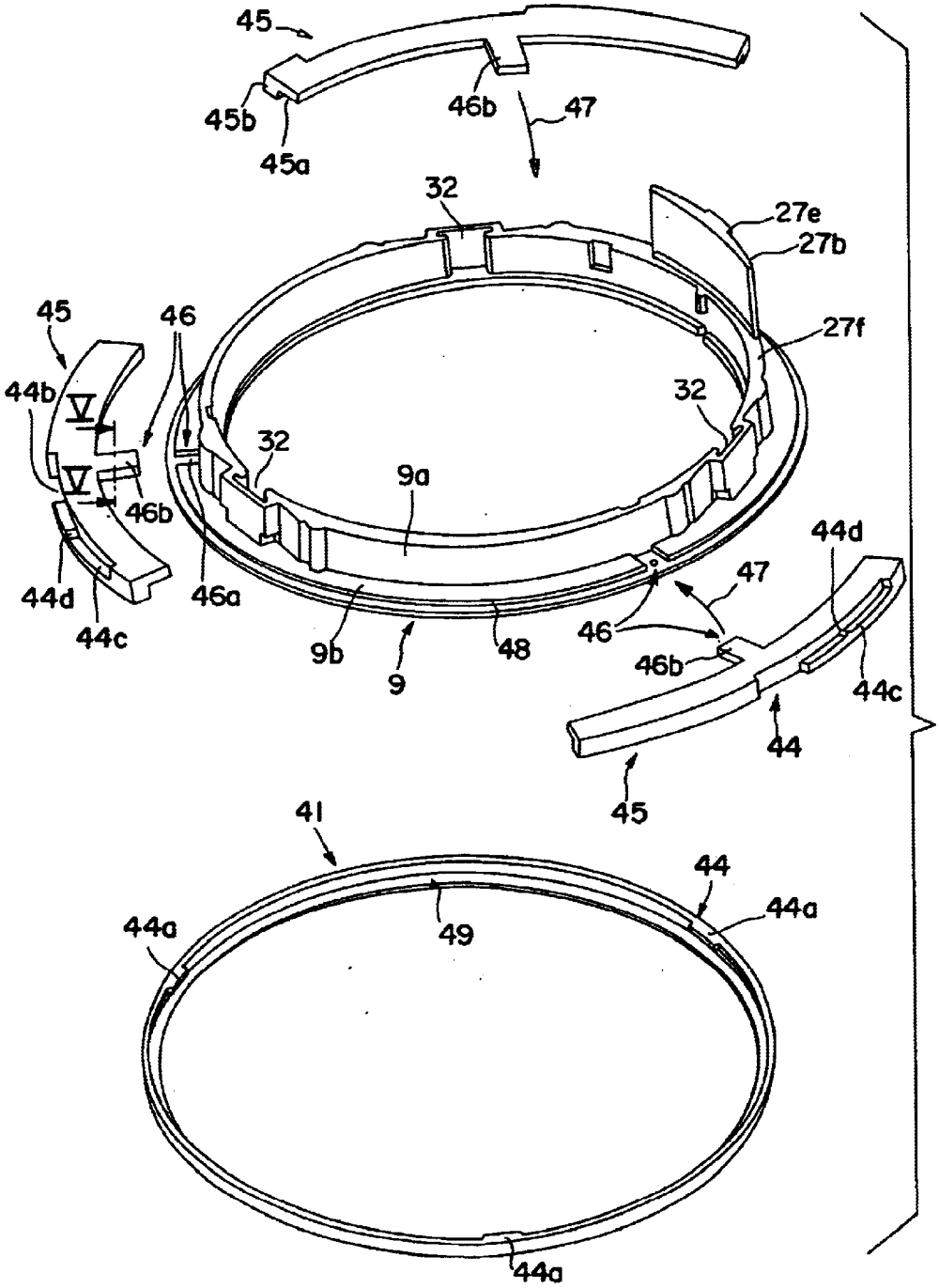
FIG. 4 is an exploded perspective view of a mounting ring with accessory parts in the luminaire of FIG. 1.

The insertion direction 47 of the plug-in fittings 46 is directed transversely of the middle axis 12, radially inwardly, as is illustrated by the associated arrows shown in FIG. 4. The plug-in recesses 46*a* are thus, referred to the middle axis 12, radially outwardly opened. They may also be open towards the inner side of the flange part 9*b* which is intended for bearing on the installation wall 3, as FIGS. 3 and 4 clearly show. With the present exemplary embodiment, the plug-in recesses 46*a*, and the plug-in pins 46*b* have each a quadrilateral, in particular flat cross-sectional form. The plug-in elements 45 are formed in an angled manner with a radially inwardly directed plug-in element limb 45*a* and a plug-in element limb 45*b* extending in the emission direction 22. On the outer edge of the flange part 9*b* away from the emission direction 22 there is arranged a ring groove 48. The plug-element limb 45*a* is, with regard to its axial dimension, so adapted to the axial depth of the ring groove 48 that on the side towards the installation wall 3 it ends approximately flush with the remaining flange section of the flange part 9*b*.

The bayonet connections 44 are each formed by means of a bayonet nose 44*a* and a bayonet recess 44*b*, and a bayonet step 44*c* adjoining onto the bayonet recess in the circumferential direction. The bayonet recess 44*b*, arranged outwardly on the plug-in element 45, is open radially outwardly and in the emission direction 22. Thus, the bayonet noses 44*a* can be introduced into the bayonet recesses 44*b* by an axial movement of the holder ring 41 opposite to the emission direction 22, and then introduced into the bayonet steps 44*c* by turning. The bayonet noses 44*a* are located radially inwardly on the edge of the holder ring 41 away from the emission direction 22. Further, the holder ring 41 may be formed by means of a thin sleeve. On at least one surface of the bayonet steps 44*c* there may be formed, for example formed on, a cam 44*d* having rounded or oblique lead-in surfaces, which constitutes a securing means, which can be manually overcome, against a reverse turning of the holder ring 41.

For holding the projecting or additional component 42, the holder ring 41 may have on its edge facing in the emission direction 22 a plurality of holder parts arranged distributed around the circumference or an encircling holder web 49, which engage or engages behind the additional component 42. The introduction of the additional component 42, for example a plate, between the bayonet noses 44*a* and the holder web 49 can be ensured for example due to the material elasticity of the holder ring 41, which is preferably of plastics. The reflector 6, the mounting ring 9, the adaptor 29, the light source carrier 7 and the plug-in elements 45 may also be of plastics. For reasons of stability it is advantageous alternatively to form the mounting ring 9 and possibly also the plug-in elements 45 and the adaptor 29 of light metal, in particular aluminum. For this purpose there is preferably suited die casting technology or injection molding technology, which make possible a rapid and an economical manufacture even with difficult shapings.

For securing the plug-in pins 46*b* in the plug-in recesses 46*a* there may be provided a positioning device. This can be formed by means of an elastically yielding pressure element, which is arranged on the one plug-in connection part and preferably latches into a recess on the other plug-in connection part. The pressure element may be formed by means of a rounded pin or a ball 51 in a transverse bore 52 in the plug-in pin 46*b* and be prevented from falling out of the bore by means of a turned in bore edge. By means of a spring 53 arranged in the bore, which bears on the base of the bore or on a closure part, the desired pressure tension can be produced.

The installation of the recessed luminaire 1 can be effected in accordance with the following method steps.

Initially, the mounting ring 9 is placed into the installation opening 2 and fixed with the holder arms 11 engaging behind the installation opening edge. The carrier bars 13 and holder arms 11 are pre-installed on the mounting ring 9 in the factory. The installation into the installation opening 2 can be carried out readily through the ring opening. Then, the light source carrier 7 is brought into its mounting position through the mounting ring 9 and connected with the mounting ring 9 by plugging in. Thereby, the connector housing 35 may be in its pivoted out or pivoted in position. The latter position improves the accessability to the connector housing 35 which is open on its side towards the holder ring. With the next method step, the reflector 6 is inserted and latched into the mounting ring 9. Then, the light source 8 or the at least one lamp can be mounted on the light source carrier 7 from the inner space of the reflector 6, for example being plugged into the fitting carrier. The connection of the operating means for current supply, arranged for example in the light source carrier 7 or in the connector housing 35, may be effected before the mounting of the mounting ring 9 or before the mounting of the light source carrier 7. Insofar as the mounting of an accessory part 42 is desired, the plug-in elements 45 are then plugged in, radially inwardly, into the plug-in recesses 46*a*, and then the holder ring 41, for example with the additional part 42 located therein, can be mounted. The de-mounting can be carried out with method steps of reverse order.

What is claimed is:

1. A recessed luminaire comprising:

a dome-shaped reflector having a light source arranged therein;

a mounting ring which engages around said reflector near said reflector's edge; and a holder ring attached to said mounting ring for holding additional components, said mounting ring including connection means for fastening said holder ring on said mounting ring, and said connection means including at least two separate plug-in elements having radially inwardly directed plug-in pins and radially developing plug-in recesses on said mounting ring which said plug-in elements can be plugged in with said plug-in pins in a direction radially inward from outside.

2. A recessed luminaire according to claim 1, wherein said plug-in elements are formed by ring segment parts which on their outer sides have a bayonet recess and a bayonet step extending in a ring circumferential direction, and said holder ring has radially inwardly directed bayonet noses for engaging said bayonet recesses and in said bayonet steps.

3. A recessed luminaire according to claim 2, wherein said mounting ring is formed with a tube support coaxial with said mounting ring and a flange part projecting outwardly from said tube support, whereby said flange part is arranged on the edge of said tube support away from said light source, and wherein said plug-in recesses are arranged in said flange part.

4. A recessed luminaire according to claim 3, wherein said flange part has a ring groove arranged on the edge of said flange part towards said light source, and wherein said ring segment parts are arranged in said ring groove.

5. A recessed luminaire according to claim 4, wherein said plug-in recesses are open on a side of said flange part towards said light source.

6. A recessed luminaire according to claim 1, wherein said plug-in recesses and said plug-in pins have a quadrilateral cross-sectional form.

7. A recessed luminaire according to claim 3, wherein said reflector has an edge flange which is arranged at a side of said flange part which is away from said light source.

8. A recessed luminaire according to claim 3, wherein said ring segment parts are each formed, in axial cross-section, in an angle shape, with a radially inwardly extending limb and a limb which extends away from said light source and which engages around said flange part.

9. A recessed luminaire according to claim 8, wherein said axial limb projects beyond said flange part at an axial spacing from said flange part.

10. A recessed luminaire according to claim 2, wherein a cam is arranged on at least one bayonet step in a manner to prevent release movement of the associated bayonet nose.

11. A recessed luminaire according to claim 1, wherein three plug-in elements are distributed around said mounting ring.

12. A recessed luminaire according to claim 8, wherein said axial limb projects beyond an edge flange on said reflector.

13. A recessed luminaire according to claim 8, wherein said axial limb comprises an inwardly projecting ring web or web segments.

* * * * *